US010363199B2

(12) United States Patent
Merhold et al.

(10) Patent No.: US 10,363,199 B2
(45) Date of Patent: Jul. 30, 2019

(54) SYRINGE ADAPTER

(71) Applicant: Raumedic AG, Münchberg (DE)

(72) Inventors: Christoph Merhold, Hof (DE); Tobias Festel, Sparneck (DE); Sebastian Maag, Bayreuth (DE); Gero Eichelkraut, Dresden (DE); Bernd Spindler, Helmbrechts (DE)

(73) Assignee: Raumedic AG, Münchberg (DE)

( * ) Notice: Subject to any disclaimer, the term of this patent is extended or adjusted under 35 U.S.C. 154(b) by 578 days.

(21) Appl. No.: 14/823,136

(22) Filed: Aug. 11, 2015

(65) Prior Publication Data

US 2016/0038374 A1 Feb. 11, 2016

(30) Foreign Application Priority Data

Aug. 11, 2014 (DE) ..... 10 2014 215 901

(51) Int. Cl.
*A61J 1/14* (2006.01)
*A61J 1/20* (2006.01)

(52) U.S. Cl.
CPC ..... *A61J 1/1493* (2013.01); *A61J 1/1487* (2015.05); *A61J 1/2096* (2013.01); *A61J 1/2075* (2015.05)

(58) Field of Classification Search
CPC ..... A61J 1/1493; A61J 1/1487; A61J 1/2096; A61J 1/2075
USPC ..... 604/414
See application file for complete search history.

(56) References Cited

U.S. PATENT DOCUMENTS

| | | | | |
|---|---|---|---|---|
| 4,303,071 | A | 12/1981 | Smith | |
| 5,425,465 | A * | 6/1995 | Healy | A61J 1/2096 141/329 |
| 5,425,468 | A | 6/1995 | Healy | |
| 6,743,214 | B2 | 6/2004 | Heil et al. | |
| 7,077,176 | B2 * | 7/2006 | Py | A61J 1/18 141/301 |
| 2010/0204670 | A1 | 8/2010 | Kraushaar et al. | |
| 2011/0168292 | A1 | 7/2011 | Luzbetak et al. | |

FOREIGN PATENT DOCUMENTS

| | | |
|---|---|---|
| DE | 20 2013 105 808 | 5/2014 |
| EP | 2266523 | 12/2010 |
| WO | 2011087987 | 7/2011 |
| WO | 2011091895 | 8/2011 |

OTHER PUBLICATIONS

EP Search Report dated Nov. 21, 2017 in corresponding EP 17 18 4242.

* cited by examiner

*Primary Examiner* — Philip R Wiest
(74) *Attorney, Agent, or Firm* — Boyle Fredrickson S.C.

(57) ABSTRACT

A syringe adapter is used for connecting a dosing syringe to a container in order to take up a fluid. The syringe adapter has a fluid delivery channel for creating a flow connection between the inside of the container and the inside of the dosing syringe. At least one ventilation channel of the syringe adapter is used for creating an air connection between the inside of the container and the container surroundings. In at least one of the channels a non-return valve is arranged, which allows the passage of media in an open position and in a closed position closes the channel. This results in a syringe adapter which has improved handing and in particular provides sufficient dosing precision.

15 Claims, 3 Drawing Sheets

SYRINGE ADAPTER

CROSS-REFERENCE TO RELATED APPLICATIONS

This application claims the priority of German Patent Application, Serial No. 10 2014 215 901.6, filed on Aug. 11, 2014, pursuant to 35 U.S.C. 119(a)-(d), the content of which is incorporated herein by reference in its entirety as if fully set forth herein.

FIELD OF THE INVENTION

The invention relates to a syringe adapter for connecting a dosing syringe to a container in order to take up fluid. The invention also relates to a set comprising at least one container, a plurality of dosing syringes and at least one such syringe adapter.

BACKGROUND OF THE INVENTION

Syringe adapters of this kind are used for administrating doses of liquid medicine for example from a storage container into a dosing syringe. Various different embodiments of such syringe adapters are already known. An adapter for connecting two fluid-carrying components in a sealed manner is known from WO 2011/091895 A1. However, known syringe adapters still need to be improved with regard to their handling and to providing a sufficiently precise dose. WO 2011/087 987 A1 discloses a syringe adapter for connecting a dosing syringe to a container. DE 20 2013 105 808 U1 discloses a device for removing medicinal liquids from storage containers provided for this by means of syringes.

US 2010/0204670 A1 discloses various different embodiments of a syringe adapter.

SUMMARY OF THE INVENTION

One objective of the present invention is to develop a syringe adapter of the aforementioned kind in order to improve its handling and to improve the precision of the dosing sufficiently.

Said objective is achieved according to the invention by a syringe adapter for connecting a dosing syringe to a container for taking up a fluid comprising a fluid delivery channel for creating a flow connection between the inside of the container and the inside of the dosing syringe, at least one ventilation channel for creating an air connection between the inside of the container and the container surroundings, wherein in at least one of the channels a non-return valve is arranged which in an open position enables the passage of media and in a closed position closes the channel, wherein a main adapter body on the one hand and the at least one non-return valve on the other hand are made at least partly from different plastic materials.

According to the invention it has been established that by creating a defined ventilation area it is possible to improve the handling and in particular improve the dosing precision when using the syringe adapter. The pulling force applied when raising the dosing syringe during the metering is reduced advantageously because of the pressure equalisation created by the ventilation channel. It is possible to avoid imprecise dosing which could be caused for example by a deformation of the dosing syringe or because of an unwanted, pressure-related displacement of a dosing piston of the dosing syringe. The formation of unwanted air bubbles in the dosing syringe is also avoided. The syringe adapter can contain exactly one ventilation channel, but can also include a plurality of ventilation channels. A main adapter body of the syringe adapter on the one hand and the at least one non-return valve on the other hand are made at least in some sections from various different plastic materials. A configuration of this kind of the syringe adapter makes it possible to adjust adapter sections specifically to their respective function. The syringe adapter can be produced in particular using 2 component techniques. In this case a soft component can be used for creating sealing elements and/or for creating valve components. Said soft component can be made in one piece which simplifies the production of the 2 component part.

A non-return valve designed as an anti-drip valve arranged in the fluid delivery channel, which opens with the application of negative pressure to a syringe-side end of the fluid delivery channel and otherwise closes, prevents the unwanted escape of fluid from the container.

A design of the anti-drip valve as a duckbill valve is reliable during operation.

A non-return valve in the form of a slit valve arranged in the fluid delivery channel, which slit valve opens on mechanical contact with a suction syringe of the dosing syringe and otherwise closes, is a simple design and can also ensure an anti-drip function. The slit of the slit valve can be formed by means of a predetermined breaking point during the first mechanical contact with the suction syringe of the dosing syringe. Alternatively, the slit of the slit valve can be formed from the start as a continuous slit.

A non-return valve designed as a ventilation valve arranged in the ventilation channel, which opens with the application of negative pressure to a container-side end of the ventilation channel and otherwise closes, prevents fluid from escaping through the at least one ventilation channel in an undesirable manner. The syringe adapter can comprise at least one non-return valve in the fluid delivery channel and at least one further non-return valve in the ventilation channel. The at least one ventilation valve can be designed with a non-return valve in the fluid delivery channel as a joint component and can be configured in particular in one piece.

Designs of the ventilation valve in the form of a duckbill valve or in the form of a shield valve have proved to be particularly suitable.

A non-return valve arranged in a common channel section of the fluid delivery channel and the ventilation channel can simultaneously take on the function of an anti-drip valve and a ventilation valve.

A syringe adapter made in one-piece of plastic has a particularly simple design.

The advantages of a set comprising at least one container, a plurality of dosing syringes and at least one syringe adapter according to the invention, which is adapted in its dimensions to the container and the dosing syringe correspond to those already described with reference to the syringe adapter. The set can provide a syringe adapter for different container sizes and/or can provide different sizes of dosing syringes.

Example embodiments of the invention are explained in more detail in the following with reference to the drawing

DESCRIPTION OF THE PREFERRED EMBODIMENT

A syringe adapter 1 is used for connecting a dosing syringe 2 to a container 3 for taking up a fluid, for example for taking up a medicinal liquid. The container 3 can consist of a commercially available plastic bottle.

Figure 1:
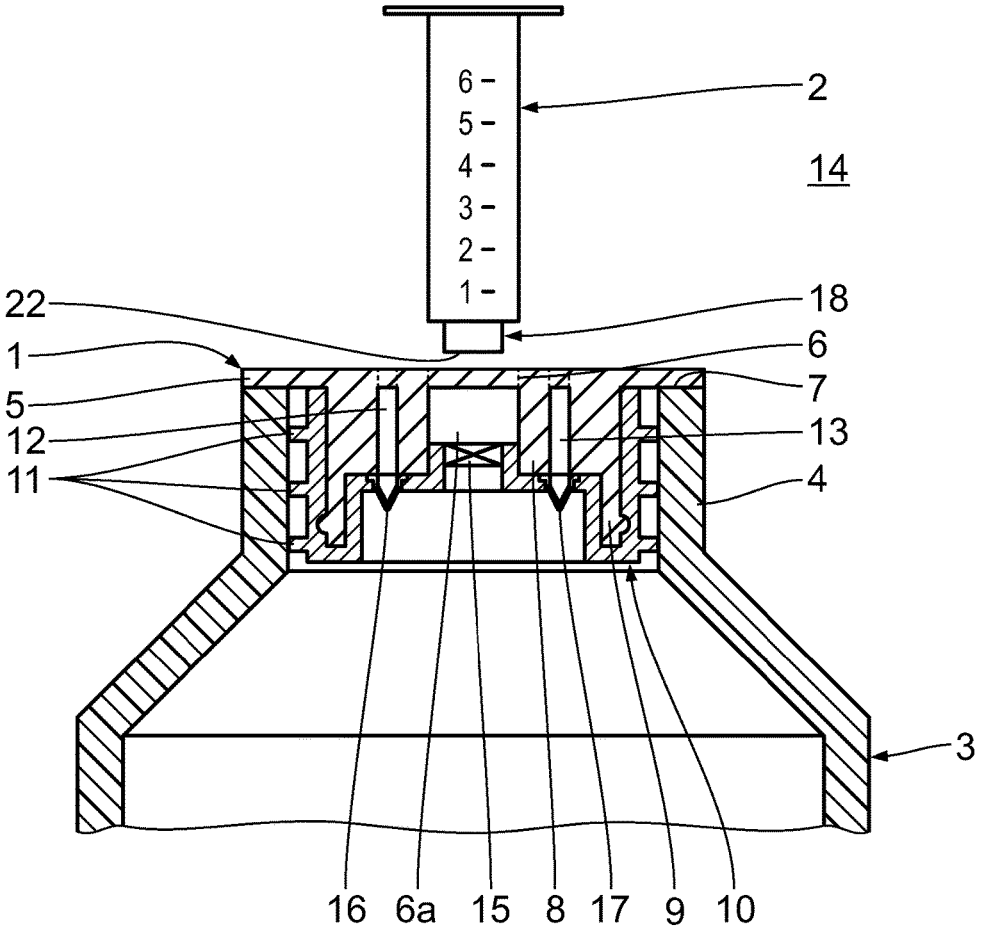
FIG. 1 shows schematically in an axial longitudinal cross section a section of a fluid container in the region of an opening neck with an inserted syringe adapter for connecting the containers to an also shown dosing syringe.

The syringe adapter 1 is inserted in the manner of a stopper seal into a neck 4 of the container 3. The syringe adapter 1 is designed as a plastic component. The embodiment according to FIG. 1 shows the syringe adapter 1 in the form of a two-component (2K) injection moulding component. A hard component of the syringe adapter 1 comprises a radially projecting bearing ring 5 with a central opening 6, which bears on the edge on an end wall 7 of the container neck 4. Extending from the bearing ring 5 into the container 3 are an inner holding structure section 8 of the hard component, in which the opening 6 continues, and an outer holding structure section 9 of the hard component. The holding structure sections 8 and 9 are formed in one piece on the bearing ring 5. The hard component is made from a polyolefin material, for example polypropylene (PP) or polyethylene (PE).

The continuation of the opening 6 into the inner holding structure section 8 forms an axially running fluid delivery channel 6*a*. The latter is used to create a flow connection between the inside of the container 3 and the inside of the dosing syringe 2, as soon as the latter has been moved into a connecting position relative to the syringe adapter 1.

A soft component 10 of the syringe adapter 1 is injected onto the holding structure 8, 9. The soft component 10 is designed as a silicon component. Part of the soft component 10 is formed by a sealing section radially surrounding the exterior of the holding structure 8, 9 with three circumferential and axially spaced apart sealing rings 11, which seal the syringe adapter 1 from an inner wall of the container neck 4.

Two axially running ventilation channels 12, 13 are formed on both sides of the fluid delivery channel 6*a* between the holding structure sections 8 and 9. The ventilation channels 12, 13 are used respectively for creating an air connection between the inside of the container 3 and the container surroundings 14.

In the fluid delivery channel 6*a* a non-return valve 15 is arranged, which in an open position enables the passage of media, namely the passage of fluid and in a closed position closes the fluid delivery channel 6*a*. The non-return valve 15 is configured as a slit valve. The non-return valve 15 is a one-piece section of the soft component 10.

Further non-return valves 16, 17 are formed in the ventilation channels 12, 13. The non-return valves 16, 17 are configured respectively as duckbill valves. The non-return valves 16, 17 in turn represent one-piece sections of the soft component 10 of the syringe adapter 1. The non-return valves 16, 17 are arranged so that they open with the application of negative pressure to a container-side end of the ventilation channels 12, 13, i.e. with the application of negative pressure inside the container 3, and otherwise close.

A main adapter body comprising the bearing ring 5 and the holding structure 8, 9 on the one hand and the non-return valves 15 to 17 on the other hand are thus made at least in part of different plastic materials.

The syringe adapter 1 and the dosing syringe 2 can be part of a set which includes at least one of the following components:

- at least one additional container,
- at least one additional syringe,
- at least one additional syringe adapter in the form of syringe adapter 1, wherein containers, syringes and syringe adapters are adjusted to one another in their dimensions respectively, so that there is always a combination of a container, dosing syringe and syringe adapter which fit together.

The syringe adapter 1 is used as follows:

Firstly the container 3 is filled with the fluid to be administered later. Then the syringe adapter 1 is fitted onto the container neck 4 and pushed into the latter until the bearing ring 5 lies on the end wall 7 of the container neck 4.

The non-return valves 15 to 17 are all closed. The slit valve 15 can be designed to have a slit that is not completely continuous at first, which has a predetermined opening point for the slit valve 15. To fill the dosing syringe 2 the latter is inserted with its suction syringe 18 through the opening 6 into the syringe adapter 1 until the suction syringe 18 passes through the slit valve 15 whereby it completely opens the slit. Then by applying negative pressure in the dosing syringe 2 the fluid in the container 3 is suctioned through the fluid delivery channel 6*a* out of the container 3 into the dosing syringe 2. In this case the soft component 10 surrounding the slit valve 15 seals the fluid delivery channel 6*a* from an outer casing wall of the suction syringe 18. During the suctioning with the dosing syringe 2 the ventilation channels 12, 13 ensure the equalisation of pressure between the inside of the container 3 and the container surroundings 14. The non-return arrangement of the duckbill valves 16, 17 thereby prevents unwanted fluid passing outwards through the ventilation channels 12, 13. After the required filling of the dosing syringe 2, which can be controlled by a scale on the syringe 2, the dosing syringe 2 is removed from the fluid delivery channel 6*a*, wherein the slit valve 15 after removing the syringe 2 seals the fluid delivery channel 6*a*. Fluid is thereby prevented from escaping the fluid delivery channel 6*a* in an unwanted manner. In this way an anti-drip function is provided with the slit valve 15.

The fluid delivery channel 6*a* is designed with respect to the channel diameter and the dimensions of the slit valve 15 to fit exactly with an outer contour of the dosing syringe 2 in the region of the suction syringe 18. It is thus possible to avoid dead volumes in the fluid outlet channel 6*a*, in which fluid can settle, without passing from the inside of the container 3 to the inside of the dosing syringe 2.

The non-return valves 15 to 17 also prevent the outlet of fluid from the inside of the container 3 during possible shaking of the fluid in the container 3 prior to the delivery of fluid to the dosing syringe 2.

Figure 2:
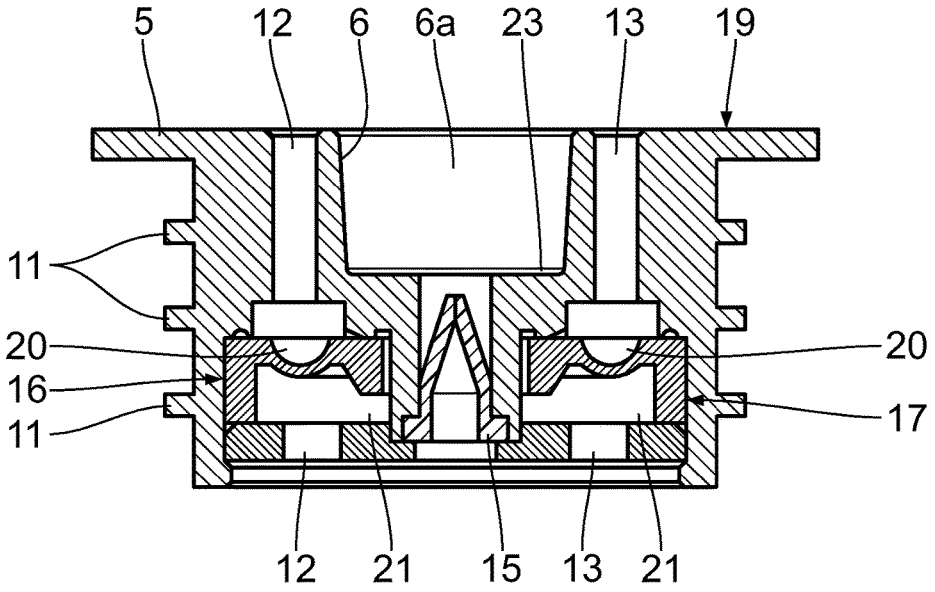
FIGS. 2 to 4 show further embodiments of a syringe adapter, which can be used instead of the syringe adapter according to FIG. 1, in an axial longitudinal cross section.

FIG. 2 shows a further embodiment of a syringe adapter 19 which can be used instead of the syringe adapter 1. Components and functions, which correspond to those that have already been explained above with reference to the embodiment according to FIG. 1, have the same reference numerals and are not discussed again in detail.

Instead of having a slit valve the non-return valve 15 in the fluid delivery channel 6*a* of the syringe adapter 19 is designed as a duckbill valve. The duckbill valve 15 is made of silicon. The duckbill valve 15 is arranged so that it opens with the application of negative pressure to a syringe-side end of the fluid delivery channel 6*a*, i.e. on suctioning via the dosing syringe 2, and otherwise closes.

The two additional non-return valves 16, 17 in the ventilation channels 12, 13 are designed in the form of shield valves which each comprise a valve body 20 and a valve mount 21. In the presence of a container-side negative pressure the respective valve mount 21 lifts from the valve body 20 of the shield valve 16 or 17 and thus enables the pressure between the inside of the container 3 and the container surroundings to be equalised. The shield valves 16, 17 are also made of silicon. The duckbill valve 15 and the two shield valves 16, 17 can be one-piece sections of a soft component of the syringe adapter 19.

To fill the dosing syringe 2 its suction syringe 18 is introduced through the opening 6 into the syringe adapter 19 until an end wall 22 (cf. FIG. 1) bears against a stop stage 23 in the fluid delivery channel 6*a*. The section of the fluid delivery channel 6*a*, in which the suction syringe 18 of the dosing syringe 2 then lies, is designed to have dimensions for avoiding dead volumes to be complementary to the suction syringe 18. Afterwards the dosing syringe 2 is drawn up, so that because of the negative pressure created thereby the duckbill valve 15 opens and a desired amount of fluid flows out of the container 3 through the duckbill valve 15 inside the dosing syringe 2. As a result of the negative pressure created in the container 3 at least one of the two shield valves 16, 17 opens. After drawing off a desired amount of fluid into the dosing syringe 2 the suction ring 18 is pulled out of the opening 6, whereby the duckbill valve 15 then closes. The unwanted escape of fluid outside the removal times is avoided by the non-return valves 15 to 17 even with syringe adapter 19.

Figure 3:
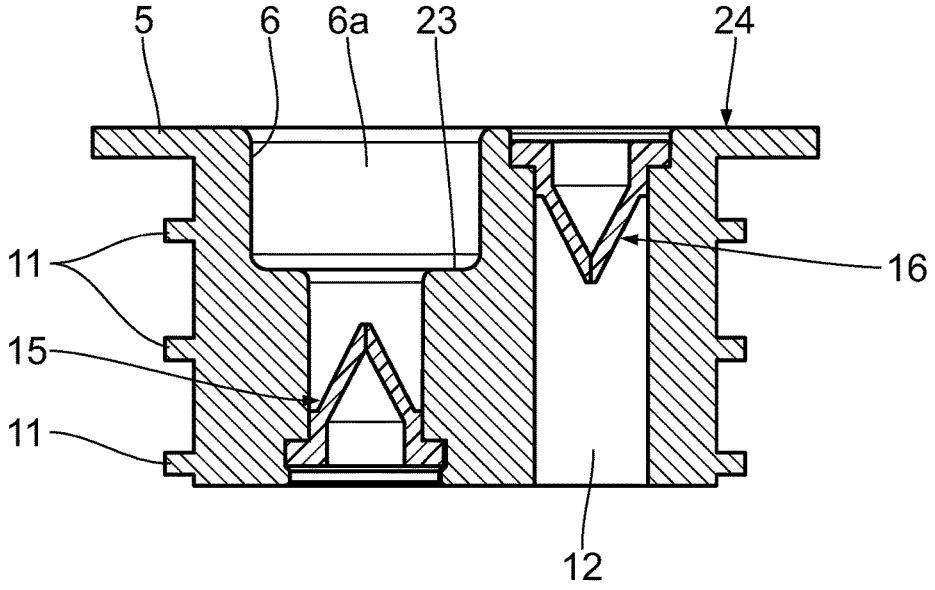

FIG. 3 shows a further embodiment of a syringe adapter 24, which can be used instead of the syringe adapter 1. Components and functions which corresponds to those already explained above with reference to the embodiment according to FIG. 1 have the same reference numerals and are not discussed again in detail.

In the syringe adapter 24 the fluid delivery channel 6*a* is not arranged centrally in the syringe adapter 24 but is off-centre. The syringe adapter 24 only has one ventilation channel 12, i.e. not two ventilation channels like the syringe adapter embodiments according to FIGS. 1 and 2.

In the ventilation channel 12 of the syringe adapter 24 a duckbill valve in the form of the duckbill valve 16 of the embodiment according to FIG. 1 is arranged as a non-return valve. Unlike the syringe adapter 1 in the syringe adapter 24 the duckbill valve 16 is arranged at the level of the bearing ring 5. The function of the duckbill valve 16 remains the same however.

Figure 4:
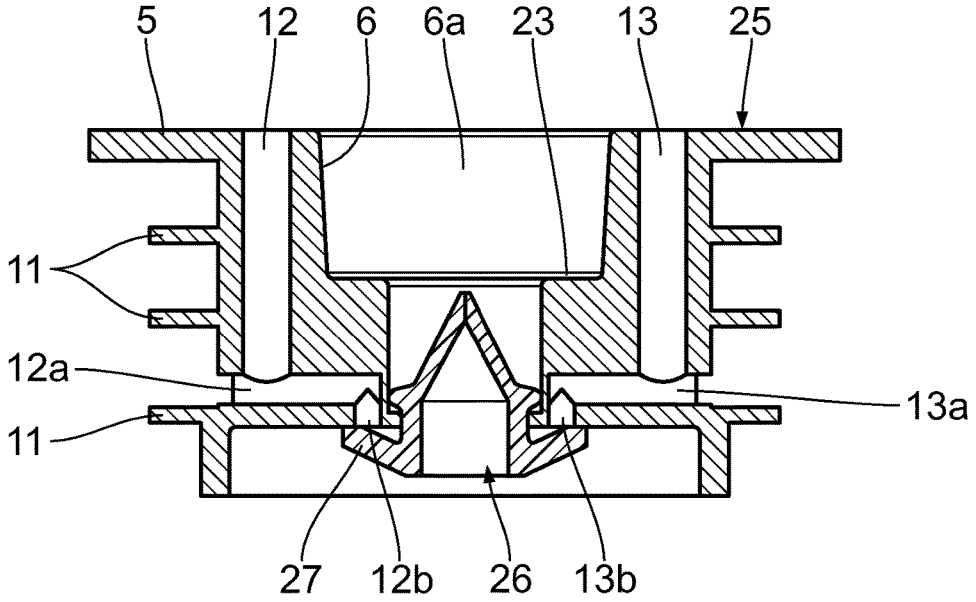

FIG. 4 shows a further embodiment of a syringe adapter 25, which can be used instead of the syringe adapter 1. Components and functions which correspond to those already described with reference to the embodiment according to FIG. 1 have the same reference numbers and are not discussed in detail again.

In the syringe adapter 25 the ventilation channels 12, 13 are step-like and in addition to axially running sections also comprise a radially running section 12*a*, 13*a*. By means of said radially running ventilation channel sections 12*a*, 13*a* and adjoining axial end sections 12*b*, 13*b* the ventilation channels 12, 13 with an inserted syringe adapter 25 open into the inside of the container 3. The channel sections 12*b*, 13*b* run radially adjacent to the fluid delivery channel 6*a*. In this area a hybrid valve 26 is arranged. The latter has on the one hand as a one-piece component the function of the duckbill valve 15 in the fluid delivery channel 6*a* and on the other hand has the function of the non-return valves 16, 17 in the ventilation channels 12, 13, as already explained above with reference to the embodiments according to FIGS. 1 and 2. To perform the ventilation function the hybrid valve 26 has a valve seat 27, which with the presence of negative pressure on the inside of the container 3 compared to the container surroundings 14 lifts from the outlet openings of the channel sections 12*b*, 13*b* and thus enables the equalisation of pressure between the inside of the container 3 and the container surroundings 14.

Figure 5:
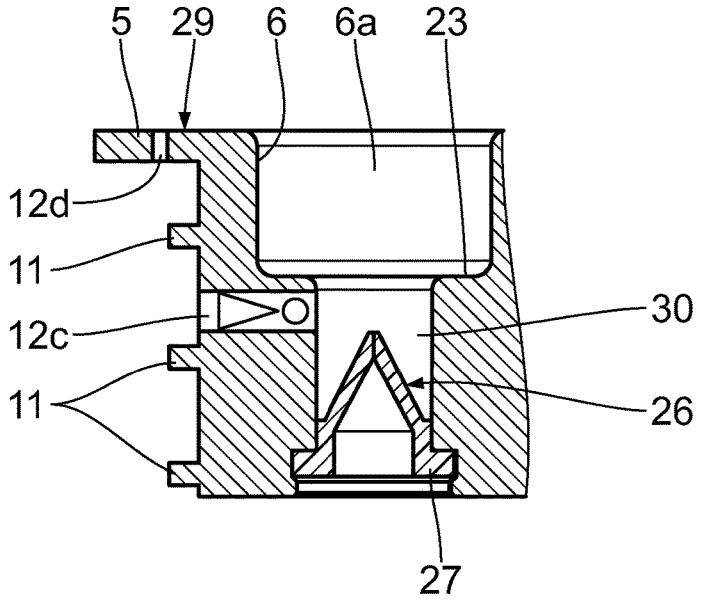
FIG. 5 shows a further embodiment of a syringe adapter, shown in an axial partial cross section.

FIG. 5 shows a further embodiment of a syringe adapter 29, which can be used instead of the syringe adapter 1. Components and functions which correspond to those that have already been explained above with reference to the embodiment according to FIG. 1 have the same reference numerals and are not discussed again in detail.

In the syringe adapter 29 a ventilation channel is formed by a radial channel section 12*c* between the fluid delivery channel 6*a* and a radially outer casing wall of the syringe adapter 29, the channel section 12*c* opening axially between two of the sealing rings 11. A further section of the ventilation channel is formed by an axially running channel section 12*d*, which is formed through the bearing ring 5. The sealing ring 11 can also comprise a ventilation recess between the channel section 12*b* and the channel section 12*c*.

With the syringe adapter 29 there is also a hybrid valve according to the hybrid valve 26 of the embodiment according to FIG. 4. To ensure the ventilation function a valve seat 27 of the hybrid valve 26 of the syringe adapter 29 lifts to release an edge-side ventilation path between the fluid delivery channel 6*a* and the inside of the container 3.

With the syringe adapter 29 from the outlet of the ventilation channel section 12*c* into the fluid delivery channel 6*a* there is a common channel section 30 of the fluid delivery channel 6*a* and the ventilation channel 12. The hybrid valve 26 is arranged in this common channel section 30.

What is claimed is:

1. A syringe adapter for connecting a dosing syringe to a container for taking up a fluid comprising:

a fluid delivery channel for creating a flow connection between the inside of the container and the inside of the dosing syringe, at least one ventilation channel for creating an air connection between the inside of the container and the container surroundings, wherein in at least one of the channels a non-return valve is arranged which in an open position enables the passage of media and in a closed position closes the channel, wherein a main adapter body on the one hand and the at least one non-return valve on the other hand are made at least partly from different plastic materials, wherein the at least one non-return valve comprises an anti-drip valve which is arranged in the fluid delivery channel, which opens with the application of negative pressure to a syringe-side end of the fluid delivery channel, and which otherwise closes, and further comprising at least one additional non-return valve which comprises a normally closed ventilation valve which is arranged in the ventilation channel, and which opens with the application of negative pressure to a container-side end of the ventilation channel wherein the anti-drip valve comprises a duckbill valve.

2. The syringe adapter according to claim 1, wherein the ventilation valve comprises a duckbill valve.

3. The syringe adapter according to claim 1, wherein the ventilation valve comprises a shield valve.

4. The syringe adapter according to claim 1, comprising a common channel section of the fluid delivery channel and the ventilation channel, wherein the non-return valve is arranged in the common channel section.

5. The syringe adapter according to claim 1, wherein the at least one non-return valve is made in one-piece of plastic.

6. A set comprising at least one container, a plurality of dosing syringes, at least one syringe adapter according to claim 1, which is adapted in its dimensions to the container and the dosing syringe.

7. The syringe adapter according to claim 1, wherein the at least one ventilation valve and the anti-drip valve in the fluid delivery channel are configured as a joint component.

8. The syringe adapter according to claim 1, wherein the at least one ventilation valve and the anti-drip valve in the fluid deliver channel are configured in one piece.

9. A set comprising:

a syringe adapter for connecting a dosing syringe to a container for taking up a fluid comprising:

a fluid delivery channel for creating a flow connection between the inside of the container and the inside of the dosing syringe, at least one ventilation channel for creating an air connection between the inside of the container and the container surroundings, a non-return valve which is arranged in at least one of the channels, wherein the non-return valve enables the passage of media when the non-return valve is in an open position thereof and closes the channel when the non-return valve a closed position thereof, wherein a main adapter body and the non-return valve are made at least partly from different plastic materials, wherein the non-return valve comprises a normally closed slit valve which is arranged in the fluid delivery channel and which opens on mechanical contact with a suction syringe of the dosing syringe;

wherein the syringe adapter comprises a soft component surrounding the slit valve;

wherein the soft component is configured to seal the fluid delivery channel from an outer casing wall of the suction syringe of the dosing syringe when the slit valve opens upon mechanical contact with the suction syringe;

wherein the non-return valve is a one-piece section of the soft component;

wherein the syringe adapter further comprises at least one additional non-return valve which is a normally closed ventilation valve that is arranged in the ventilation channel and that opens with the application of negative pressure to a container-side end of the ventilation channel; and wherein the at least one ventilation valve is a one-piece section of the soft component.

10. The set according to claim 9, wherein the ventilation valve comprises a duckbill valve.

11. The set according to claim 9, wherein the ventilation valve comprises a shield valve.

12. The set according to claim 9, further comprising a common channel section of the fluid delivery channel and the ventilation channel, wherein the non-return valve is arranged in the common channel section.

13. The set according to claim 9, wherein the at least one non-return valve is made of one piece of plastic.

14. The set according to claim 9, further comprising:

at least one container, a plurality of dosing syringes, at least one syringe adapter.

15. The set according to claim 9, wherein the slit valve comprises a slit that is formed by way of a predetermined breaking point during the first mechanical contact with the suction syringe of the dosing syringe.

* * * * *